US008110996B2

(12) United States Patent
Budike, Jr.

(10) Patent No.: US 8,110,996 B2
(45) **Date of Patent: *Feb. 7, 2012**

(54) MODULAR WIRELESS LIGHTING CONTROL SYSTEM USING A COMMON BALLAST CONTROL INTERFACE

(76) Inventor: Lothar E. S. Budike, Jr., Villanova, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/856,384

(22) Filed: Aug. 13, 2010

(65) Prior Publication Data

US 2010/0301781 A1 Dec. 2, 2010

Related U.S. Application Data

(63) Continuation of application No. 11/599,621, filed on Nov. 15, 2006, now Pat. No. 7,812,543.

(51) Int. Cl.
*H05B 37/02* (2006.01)

(52) U.S. Cl. ..... 315/157; 315/158; 315/291; 315/312

(58) Field of Classification Search ..... 315/149, 315/156–159, 291, 307–308, 312
See application file for complete search history.

(56) References Cited

U.S. PATENT DOCUMENTS

| | | | | |
|---|---|---|---|---|
| 4,866,350 | A | 9/1989 | Counts | |
| 4,994,718 | A * | 2/1991 | Gordin | 315/240 |
| 5,451,843 | A * | 9/1995 | Kahn et al. | 315/186 |
| 5,672,941 | A | 9/1997 | Callahan et al. | |
| 5,701,058 | A | 12/1997 | Roth | |
| 5,726,644 | A | 3/1998 | Jednacz et al. | |
| 5,838,116 | A | 11/1998 | Katyl et al. | |
| 6,114,816 | A * | 9/2000 | Nuckolls et al. | 315/324 |
| 6,340,864 | B1 | 1/2002 | Wacyk | |
| 6,707,256 | B2 | 3/2004 | Brunker et al. | |
| 7,109,668 | B2 | 9/2006 | Pogodayev et al. | |
| 7,118,235 | B2 | 10/2006 | Barton | |
| 7,429,828 | B2 | 9/2008 | Cleland | |
| 7,812,543 | B2 * | 10/2010 | Budike, Jr. | 315/157 |
| 2002/0175641 | A1 | 11/2002 | Andersen | |
| 2002/0190660 | A1 * | 12/2002 | Cao | 315/149 |
| 2003/0001523 | A1 * | 1/2003 | Belliveau | 315/291 |
| 2003/0090889 | A1 | 5/2003 | Wacyk et al. | |
| 2006/0116030 | A1 | 6/2006 | Niiyama et al. | |
| 2007/0278964 | A1 | 12/2007 | Den Ridder | |

* cited by examiner

*Primary Examiner* — Tung X Le
(74) *Attorney, Agent, or Firm* — McKenna Long & Aldridge, LLP

(57) ABSTRACT

Disclosed is a modular lighting system that incorporates wireless technology and a standard interface. The lighting system may be installed in new buildings or retrofitted into existing buildings in such a way that provides many lighting configurations and programmability options while minimizing the amount of new wiring. The system includes a transceiver that controls one or more lamps using a dimming ballast or a relay and a low cost ballast. The dimming ballast, and the relay (if used) provide low voltage power to the transceiver over a cable having a standard interface, such as an RJ11 telephone jack. The transceiver provides on/off switching control and dimmer control, through the same cable, to the relay or dimming ballast. The transceiver can be located in the same room as the lamps it controls, or remotely located. A central computer or controller can control multiple transceivers over a wireless link.

11 Claims, 8 Drawing Sheets

MODULAR WIRELESS LIGHTING CONTROL SYSTEM USING A COMMON BALLAST CONTROL INTERFACE

This application is a continuation of U.S. patent application Ser. No. 11/599,621, filed Nov. 15, 2006 now U.S. Pat. No. 7,812,543, now allowed, which is incorporated by reference for all purposes as if fully set forth herein.

BACKGROUND OF THE INVENTION

1. Field of the Invention

The present invention generally relates to lighting systems. More particularly, the present invention relates to lighting systems for residential or commercial structures in which energy conservation and ease of upgrading existing lighting systems are major concerns.

2. Discussion of the Related Art

Central lighting control systems, as used in commercial buildings, automatically turn lights on and off based on time of day. Many lighting control systems have included motion sensors and light harvesting sensors, which provide additional control in turning lights on and off. Motion sensors are typically used in areas, such as hallways or storage rooms, in which people are occasionally present. Light harvesting sensors, typically used in exterior offices with windows, turn lights on and off based on the presence of ambient sun light. The additional control provided by motion sensors and light harvesting sensors is intended to improve energy efficiency.

Central lighting systems typically use hard-wired switch relays on lighting circuits that are located in a central control box.

Central lighting control based on time of day, motion, and ambient sunlight, are expensive to implement. First, they are expensive to install because each individual circuit line feeder must be wired back to a central system. In many cases, these lighting systems are retrofitted into existing buildings, which is extremely labor intensive and generally cost prohibitive, especially in large commercial office buildings. Further, related art central lighting control systems are restricted to on/off functionality, because they rely on the use of relays. As such, dimming control is generally not available in a central lighting control system.

Second, lighting control systems that utilize motion, light harvesting, and time of use controls generally need to provide a secondary signal, such as a low voltage control signal, via a control wire that is connected to each of the lighting fixtures' ballasts. For instance, if two or three fixtures are controlled by a light harvesting sensor, each of the fixtures will need to be wired in parallel to the sensor. Accordingly, an electrician has to run a control wire from light fixture to light fixture and then back to the sensor. If two or three fixtures are to be controlled by a motion sensor, the same holds true in that the electrician has to run a control wire from fixture to fixture and then back to the motion sensor. The running of a control wire to each fixture is very expensive, which prevents most enterprises from retrofitting their offices with more energy efficient lighting control systems.

What is needed is a lighting control system that can be installed with minimal invasive wiring to the lighting circuit and the individual ballasts, enables dimming control, and can take advantage of motion sensors and light harvesting sensors to improve energy efficiency.

SUMMARY OF THE INVENTION

The present invention provides a modular wireless lighting control system using a common ballast control interface that obviates one or more of the aforementioned problems due to the limitations of the related art.

Accordingly, one advantage of the present invention is that it reduces the expense of updating or retrofitting existing buildings with more efficient and advanced lighting control products.

Another advantage of the present invention is that it provides easier and more effective ways of controlling lighting to minimize energy consumption.

Still another advantage of the present invention is that it reduces the number of different types of lighting components used in a given structure.

Additional advantages of the invention will be set forth in the description that follows, and in part will be apparent from the description, or may be learned by practice of the invention. The advantages of the invention will be realized and attained by the structure pointed out in the written description and claims hereof as well as the appended drawings To achieve these and other advantages, the present invention involves a lighting control system. The lighting control system comprises a transceiver having a data processing unit, an interface circuit, and a first plug that is connected to a first end of an interface cable; and a dimming ballast connected to a second end of the interface cable, wherein the dimming ballast is configured to provide a voltage to power the transceiver, and the transceiver is configured to provide an on/off control to the dimming ballast.

In another aspect of the present invention, the aforementioned and other advantages are achieved by a lighting control system, which comprises a sensor; a power interface connected to the sensor by an interface cable; and a ballast connected to the power interface, wherein the power interface is configured to provide, over the interface cable, a voltage to power the sensor, and wherein the sensor is configured to provide, over the interface cable, an on/off signal to the ballast.

In another aspect of the present invention, the aforementioned and other advantages are achieved by a transceiver for a wireless lighting control system. The transceiver comprises a data processing unit; an interface circuit connected to the data processing unit; and a jack that is connectable to an interface plug, the jack having a first pin corresponding to an on/off signal, a second pin corresponding to a ground signal, and a third pin corresponding to a voltage power signal that provides power to the transceiver, wherein the data processing unit has a computer readable medium encoded with a program for receiving a command signal from an external controller and for sending a control signal to the interface circuit, wherein the control signal corresponds to the command signal, and wherein the on/off signal is a function of the control signal.

In another aspect of the present invention, the aforementioned and other advantages are achieved by an interface device for a lighting system, which comprises a cable having a plurality of conductors; and an interface plug disposed at an end of the cable, wherein the interface plug has a first pin that conducts an on/off signal from a host device to a lamp ballast device, a second pin that conducts a ground signal from the lamp ballast device to the host device, and a third pin that conducts a low voltage signal from the lamp ballast device to the host device for providing power to the host device, wherein the first pin, the second pin, and the third pin correspond to the plurality of conductors.

In another aspect of the present invention, the aforementioned and other advantages are achieved by a power interface device for a lighting control system, which comprises a power converter; a power switch; and a jack connected to the power converter and the power switch, wherein the jack has a first pin that corresponds to an On/Off signal, wherein the first pin is connected to the power switch; a second pin that corresponds to a ground signal, wherein the second pin is connected to the power converter; and a third pin that corresponds to a DC voltage, wherein the third pin is connected to the power converter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

The present invention involves the use of a standard interface that provides wireless control of a ballast while minimizing the electromagnetic interference that a ballast transformer would impart on a wireless transceiver. The standard interface enables different lighting components, such as motion sensors, light harvesting sensors, relays, etc., to derive power, such as DC power, from the ballast and provide control signals, such as dimming control, to the ballast. The standard interface enables one to easily design and install one or more lighting systems for a room with minimal invasive wiring. Further, by using modular components that connect to the standard interface, and a standard interface cable, a building can have a variety of lighting configurations in different rooms while minimizing the number of different parts to maintain in inventory. Additionally, by using modular components with standard interfaces, and by incorporating wireless technology, existing buildings can be retrofitted with advanced lighting systems without the need for new wires to be run through the building. Still further, as new modular components enter the market, they may be integrated into existing modular lighting systems according to the present invention with reduced effort and time to install.

Figure 1:
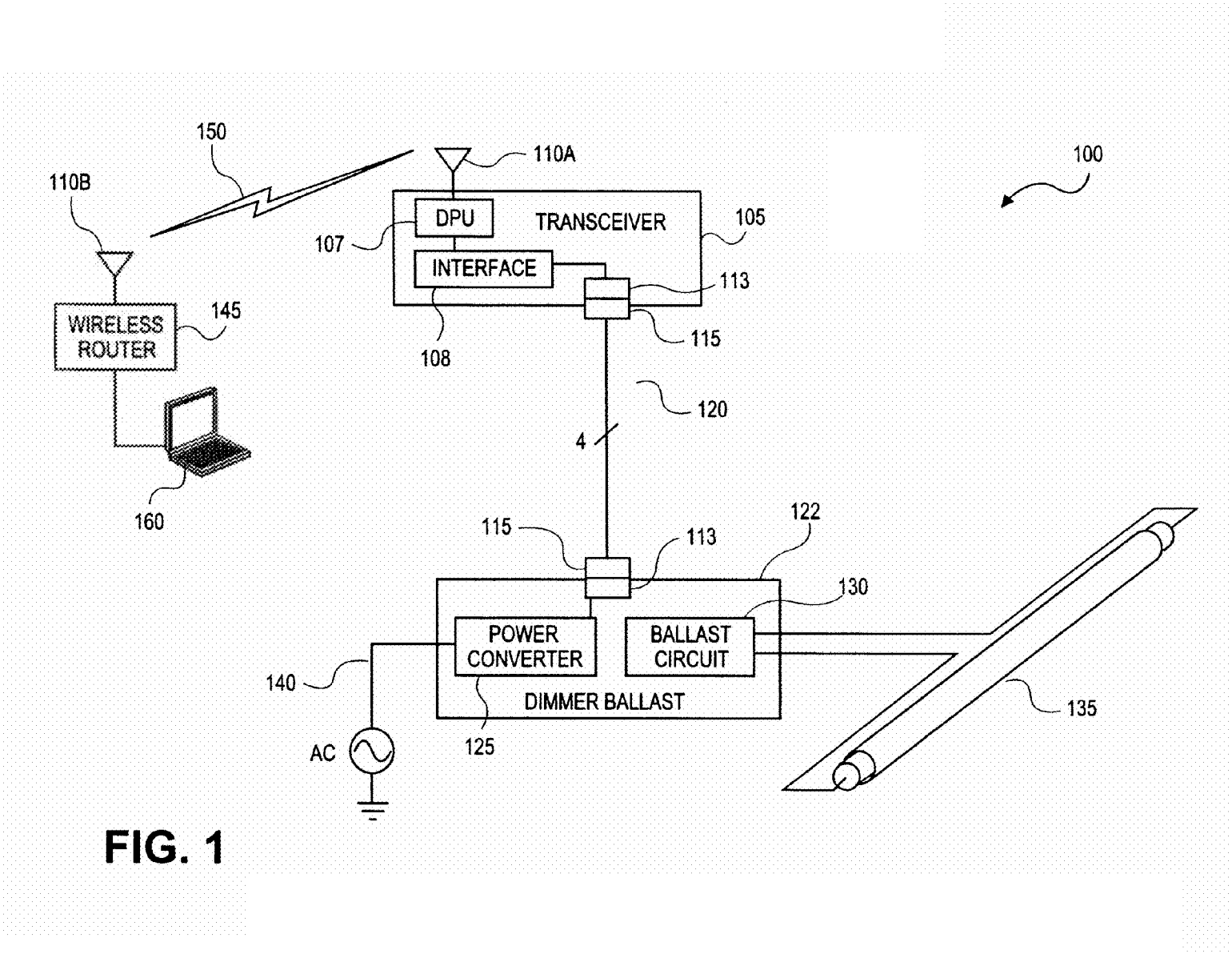
FIG. 1 illustrates an exemplary system employing wireless control of a dimming ballast.

FIG. 1 illustrates an exemplary system 100 that employs wireless control of a dimming ballast according to the present invention. System 100 includes a transceiver 105 having an antenna 110*a*; a wireless router 145 that uses an antenna 110*b* to communicate with transceiver 105 over a wireless link 150; and a user interface computer 160 connected to wireless router 145. Transceiver 105 is connected to a dimming ballast 122 over an interface cable 120, which has a interface plug 115 at either end. Dimming ballast 122 may have a jack 113, which mates with interface plug 115, a power converter 125, and a ballast circuit 130. Dimming ballast 122 may derive power from an AC source 140 (e.g., 120V or 277 V). Further, dimming ballast 122 may be connected to a lamp 135.

User interface computer 160 may include one or more commercially available computers that is/are connected to wireless router 145 over a network, which may include the interne. Alternatively, user interface computer 160 may be a controller device, such as a commercially available wall-mounted control unit, which may be mounted on a wall of the room (or nearby room) in which system 100 is installed. User interface computer 160 may control system 100 by using special purpose software, or by using a web-based control software that runs on a browser. A further discussion of internet-based control of a lighting system can be found in published U.S. Patent Application, Publication No. 20050097162, WIRELESS INTERNET LIGHTING CONTROL SYSTEM, which is incorporated by reference as if fully disclosed herein.

Transceiver 105 and wireless router 145 may communicate over wireless link 150 using one or more of a number of wireless communications schemes, such as fixed frequency, spread-spectrum, ultra wide-band, WiFi (IEEE 802.11), Zigbee (IEEE 802.15.4), Bluetooth, Mesh, etc. Non RF-based communication schemes, such as infrared, or Power Line Carrier (PLC) implementations, are possible and within the scope of the invention. The communication scheme implemented for radio link 150 need not require high bandwidth, because light control information sent from wireless router 145 to transceiver 105 would not occur very often. Wireless link 150 may need to be sufficiently robust to penetrate multiple walls, such as in a large commercial structure. Further, repeaters (not shown) may be used to extend the range of wireless link 150. Antennas 110*a* and 110*b* may be compatible with one or more of the above communication schemes chosen for wireless link 150. As such, antennas 110*a* and 110*b* may each be one antenna or multiple antennas, depending on the chosen communication scheme or schemes. It will be readily apparent to one skilled in the art that many architectures for implementing wireless link 150 are possible and within the scope of the invention.

Transceiver 105 may have an antenna 110*a*, a data processing unit 107, a jack 113, and an interface circuit 108 connected jack 113. Data processing unit 107 may contain a processor or microcontroller, which may include and a memory encoded with embedded software for establishing a communication bridge over wireless link 150, identifying devices connected to the transceiver 105, and for controlling any connected devices in response to commands from interface computer 160. Data processing unit 107 may derive power from interface circuit 108 and may provide control signals to jack 113 via interface circuit 108. Data processing unit 107 may also include antenna interface and signal conditioning circuitry through which it is connected to antenna 110*a*.

Transceiver 105 may further include a binary switch, such as a dip switch (not shown), which may be set to a binary value that corresponds to an address for transceiver 105. Accordingly, if multiple transceivers 105 are used in a lighting system, each may be given independent addresses (by setting the dip switch) so that user interface computer 160 may command each transceiver 105 independently. Further, in a lighting system having many transceivers, one or more groups of transceivers 105 may be given the same address so that user interface computer may simultaneously command multiple lighting fixtures identically. The use of a dip switch is exemplary; other address-setting mechanisms may be used and are within the scope of the invention.

Figure 2A:
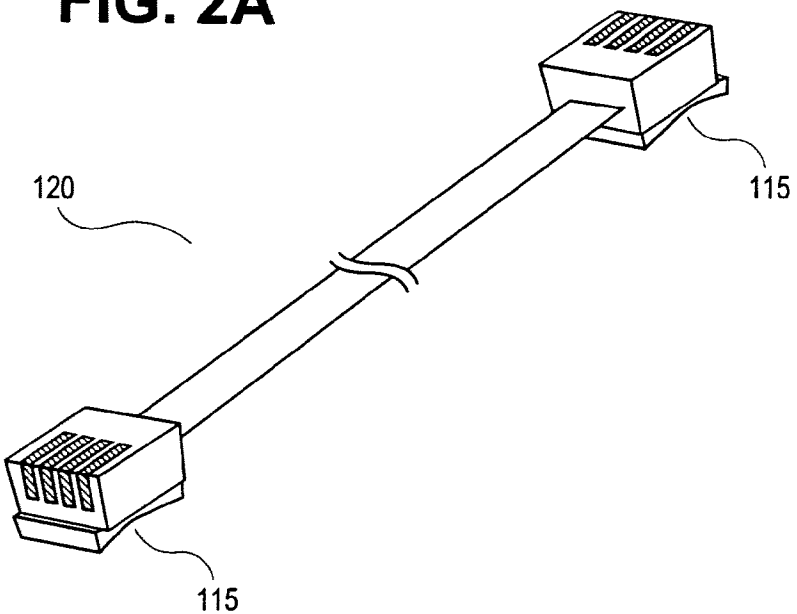
FIG. 2A illustrates an exemplary interface cable according to the present invention.

FIG. 2A illustrates an exemplary interface cable 120 that connects the modular components described herein. Interface cable 120 may come in various lengths, depending on the size of the room in which system 100 (or any the later-described systems) is to be installed. Interface plug 115 may be one of several standard telephone plugs commonly in use. For example, interface plug 115 may be a small Class 1 or 2 telephone plug, such as an RJ11, RJ14, or R145 plug. Other plugs may be used provided that they have a sufficient number of conductors and are easy to connect and disconnect in hard to reach locations. Interface cable 120 may be used to connect any of the components discussed herein.

Figure 2B:
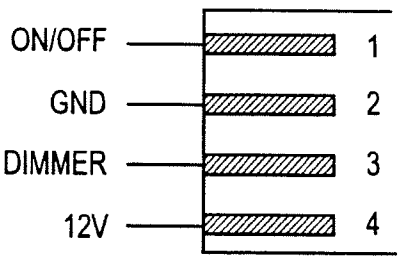
FIG. 2B illustrates an exemplary pin assignment for the interface cable of FIG. 2A.

FIG. 2B illustrates an exemplary pin assignment for interface plug 115. If an RJ11 plug is to be used, an exemplary pin assignment may be as follows. Pin 1 is assigned an On/Off signal for controlling dimming ballast 122; pin 2 is assigned a ground, which may be the same as a low voltage dimmer ground; pin 3 is assigned a 0-10V dimmer line; and pin 4 is assigned a 12V regulated or 15-21V unregulated (50 mA max) power source line, also referred to herein as a low DC voltage. It will be readily apparent to one skilled in the art that variations to this pin assignment, and variations to the voltages and signals therein, are possible and within the scope of the invention.

Referring again to FIG. 1, dimming ballast 122 provides power to transceiver 105, and transceiver 105 provides control signals to dimming ballast 122, over interface cable 120. Dimming ballast 122 includes a power converter 125 and a ballast circuit 130. Power converter 125 may downconvert AC power from AC source 140 into a low DC voltage (for example, 5-12V, although other voltage ranges, such as 3.3V or 5V to 12V are possible). Further, power converter 125 may generate an unregulated voltage, such as a 21V unregulated signal, for the low voltage DC signal. The specific low DC voltage generated by power converter 125 may depend on the power requirements of transceiver 105. Power converter 125 may use one of a number of methods for power conversion. For example, power converter 125 may include a switching power supply, or a transformer with a rectifier circuit. Power converter 125 may also do direct AC conversion. Power converter 125 also provides AC power to ballast circuit 130.

Power converter 125 provides the low DC voltage signal to interface plug 115 (pin 4 in the above example) via a jack 113 to which interface plug 115 attaches. Power converter 125 may include a diode to limit the direction of the power output of the low voltage signal. For example, a diode that limits current to 50 mA, such as a 1N4148 diode, may be used. Other diodes may be used, depending on the gauge of the pins in interface plug 115, the gauge of the conductors in interface cable 120, and the expected power requirements of transceiver 105.

The low DC voltage signal generated by power converter 125 is received by interface circuit 108 of transceiver 105 via pin 4 of interface plug 115. Interface circuit 108 may process the voltage signal, such as by filtering it and/or stepping it up or down with a DC/DC converter or the like, for the sake of powering the components in transceiver 105.

Interface circuit 108 may have an open collector analog circuit connected to pin 1 of interface plug 115, whereby pulling pin 1 to ground will shut off power to dimming ballast 122. However, one skilled in the art will appreciate that other circuit configurations for switching dimming ballast 122 on and off are possible and within the scope of the invention.

Interface circuit 108 may apply the analog dimmer voltage to pin 3 in a variety of ways. For example, interface circuit 108 may have a variable resistor that is controlled by a printed wiring board (PWB) FET. Alternatively, interface circuit 108 may implement a D/A converter using an "R2R" resistor ladder array. It will be readily apparent to one skilled in the art that many such implementations of interface circuit 108 are possible and within the scope of the invention.

Because transceiver 105 is spaced apart from power converter 125, ballast RF noise resulting from RF interference generated by power converter 125 is substantially mitigated. Further, because transceiver 105 draws its power from dimming ballast 122, no additional wiring is required for transceiver 105. Accordingly, transceiver 105 may be placed so that it is easily accessible, or for optimal reception by antenna 110*a*, with the only wiring constraint that it be reachable by interface cable 120. Further, retrofitting dimming ballast 122 in an existing fixture would not require any new wiring because its only connections are to AC source 140, which would be pre-existing, and interface cable 120.

System 100 may function as follows. Transceiver 105 receives commands from user interface computer 160 via wireless router and wireless link 150. Data processing unit 107 receives the commands from antenna 110*a* and converts these commands into instructions for dimming ballast 122. Data processing unit 107 then sends the instructions to interface circuit 108, which converts these instructions into signals that it sends to ballast circuit 130 via interface cable 120. For example, if the instruction is to turn lamp 135 on or off, data processing unit 107 may instruct interface circuit 108 to apply the corresponding voltage to the On/Off signal assigned to pin 1 (in the above exemplary pin configuration). If the command from user interface computer is to dim lamp 135, or otherwise modulate the brightness of lamp 135, data processing unit 107 instructs interface circuit 108 to provide a corresponding analog voltage (e.g., within a 0-10 V range) to the dimmer line assigned to pin 3 on jack 113.

If the instruction is to adjust dimmer in dimming ballast 122, data processor unit 107 may apply an appropriate digital value to a digital to analog (D/A) converter (not shown), which then applies the analog voltage to the dimmer signal assigned to pin 3 of interface plug 115. This dimmer voltage is received by ballast circuit 130 (via interface cable 120), which in turn applies the corresponding power to lamp 135.

Variations to system 100 are possible. For example, ballast circuit 130 may be a commercial dimming ballast that provides a low voltage DC output from internal power conversion circuitry (not shown). If this is the case, power converter 125 may not be necessary. In such a case, dimming ballast 122 may include an interface that connects the appropriate pins in jack 113 to the appropriate leads in the commercial dimming ballast. The interface, and the jack 113, may take the form of a retrofit kit, which may be easily integrated with the commercial dimming ballast. It will be readily apparent to one skilled in the art that such variations of system 100 are possible and within the scope of the invention.

Figure 3:
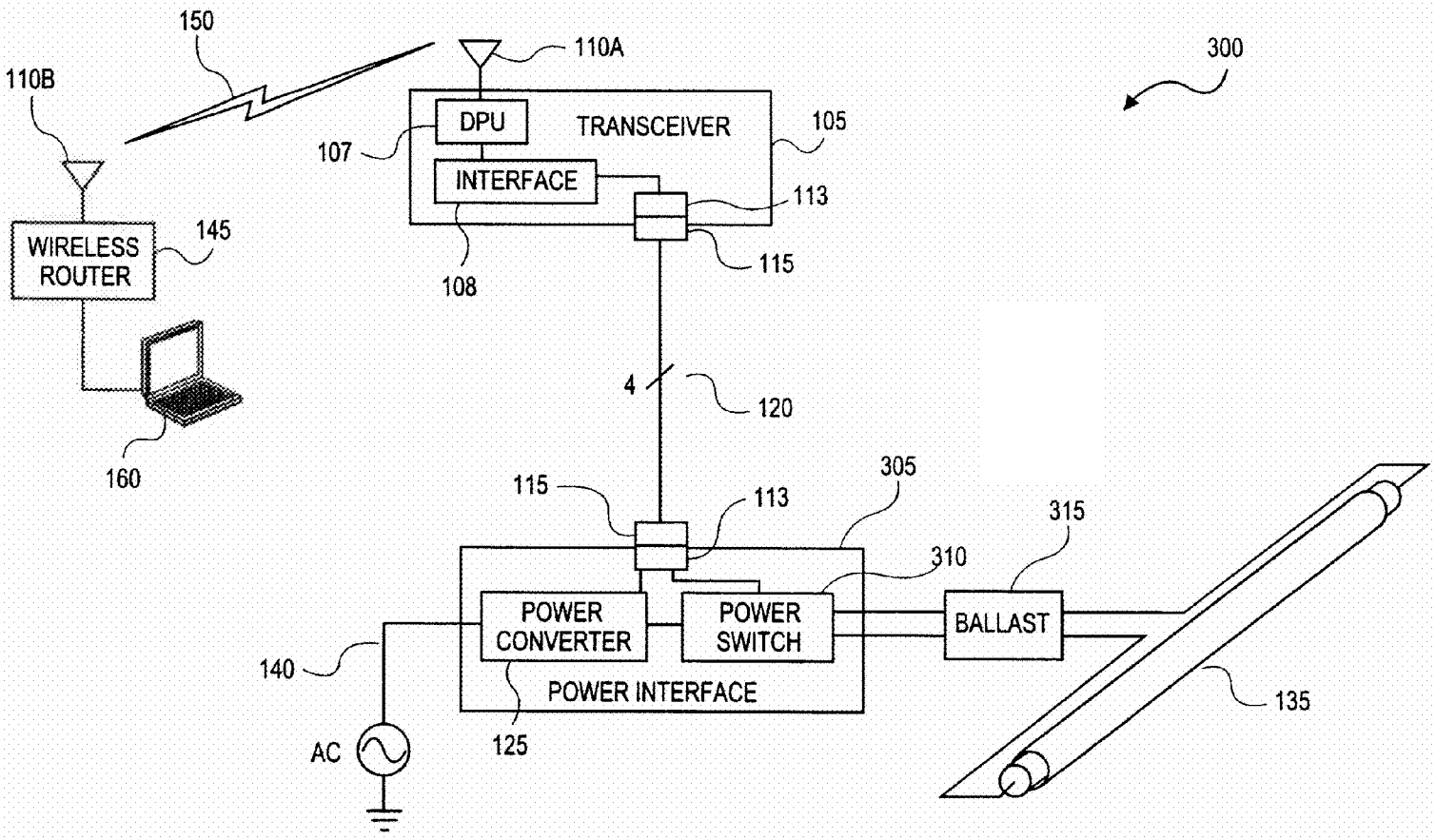
FIG. 3 illustrates an exemplary system employing wireless control of a power interface circuit of the present invention connected to a standard ballast.

FIG. 3 illustrates an exemplary system 300 employing wireless control of a relay connected to a standard ballast.

System 300 includes a transceiver 105 that communicates with a wireless router 145 over a wireless link 150, similarly to system 100. A difference between system 300 and system 100 is that system 300 uses a standard ballast 315 that does not have a dimmer feature. Here, a ballast 315 is connected to a power interface 305, which is connected to transceiver 105 via interface cable 120.

Power interface 305 may have a power converter 125, like that in system 100, and a power switch 310, which may act as a relay in providing power to ballast 315. Power switch 310 may be a commercially available relay that is connected to jack 113 and power converter 125. Alternatively, power switch may be a semiconductor switch, such as a triac switch. Any such switch may be used provided that it accepts an On/Off signal like that which can be provided by interface circuit 108, and that can switch sufficient power to drive lamp 135, which may be one or more lamps. One skilled in the art will readily recognize that various switch devices may be used for power switch 310, all of which are within the scope of the invention.

In system 300, power converter 125 converts the AC voltage from AC source 140 into a low voltage DC signal in a manner similar to that described with respect to system 100 above. Power converter 125 applies this voltage to pin 4 of jack 113, which provides power to transceiver 105 in a manner similar to that described above.

The exemplary process for switching on and off dimming ballast 122 in system 100 is substantially similar to that for system 300 here. However, in system 300, transceiver 105 sends the On/Off signal to power switch 310 (instead of ballast circuit 130) via pin 1 of interface plug 115 to switch ballast 315 on and off.

In system 300, ballast 315 may also be one of any low-cost commercially available ballasts, which is connected to power converter 125 and jack 113 via leads provided with ballast 315. In system 300, the dimmer signal, which is assigned to pin 3 of exemplary pin assignment above, is not used. As such, the same transceiver 105 and interface cable 120 may be used in either of systems 100 and 300.

Figure 4:
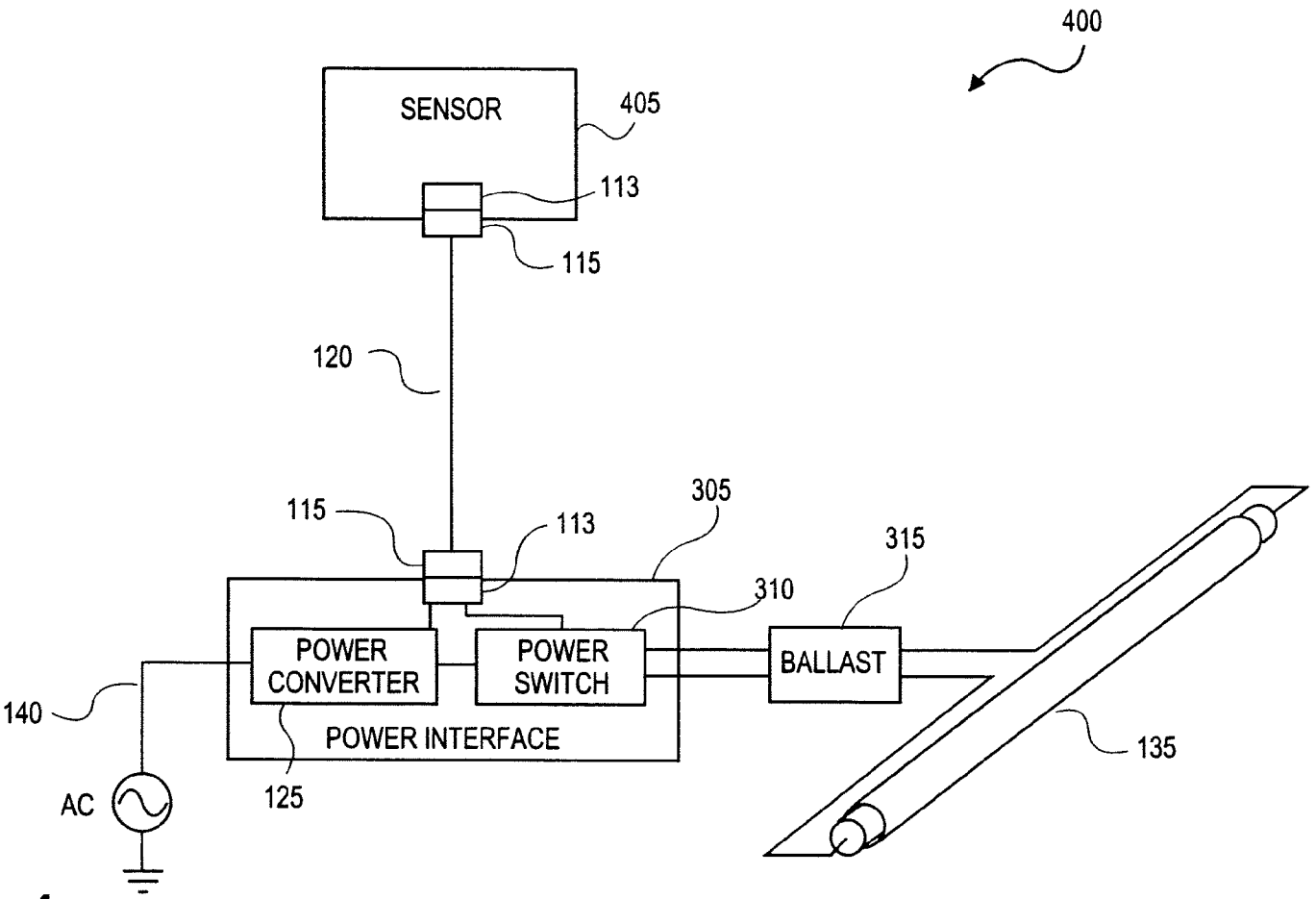
FIG. 4 illustrates an exemplary system using a sensor to control a power interface circuit connected to a standard ballast.

FIG. 4 illustrates an exemplary system 400 using a sensor 405 to control a standard ballast. Sensor 405 may be a light harvesting sensor, a motion sensor, or some other device that can be used to switch lights on and off in response to a certain condition. The remaining components in system 400 may be the same as those described in system 300 above. In system 400, sensor 405 draws low voltage DC power from pin 4 of interface plug 115, which is derived from AC power source 140 by power converter 125. This is similar to how transceiver 105 draws power in system 300.

In the case in which sensor 405 is a light harvesting sensor, system 400 may be installed in a room that occasionally receives sunlight, or light from another source. When sensor 405 (as a light harvesting sensor) detects ambient light from another source, it sends a signal to On/Off pin 1 of interface plug 115, which switches off power switch 310 via interface cable 120. Conversely, when sensor 405 detects an absence of ambient light, it sends a signal to On/Off pin 1 of interface plug 115, which switches on power switch 310 via interface cable 120.

Sensor 405 may have its own wireless transceiver (not shown), whereby sensor 405 may be controlled (e.g., enabled/disabled) via a wireless link (not shown) in a manner similar to that of systems 100 and 300. In this case, sensor 405 may have a digital switch, such as a dip switch, that enables sensor 405 to be independently addressed by a wireless control network (not shown). It will be readily apparent to one skilled in the art that such variations are possible and within the scope of the invention.

In an alternative to system 400, power interface 305 and ballast 315 may be replaced with dimming ballast 122 of system 100. In the example in which sensor 405 is a light harvesting sensor, sensor 405 may detect ambient light and send an analog voltage (such as in a 0-10V range) to dimmer pin 3 of interface plug 115. This analog voltage is received by ballast circuit 140 in dimming ballast 122, which may control the output of lamp 135 in response to the ambient light detected by sensor 405. In this manner, the amount of light in a room may be held constant in the presence of changing sunlight conditions while minimizing power consumption by lamp 135.

In another example, sensor 405 may be a motion sensor. In this case, system 400 may be installed in an area such as a hallway or a storage room, in which people are intermittently present. In this example, on detecting motion, sensor 405 (a motion sensor) sends an signal to On/Off pin 1 of interface plug 115, which switches on power switch 310 via interface cable 120, which in turn switches on lamp 135. After a prescribed amount of time (programmed into motion sensor example of sensor 405) in which motion has not been detected, sensor 405 sends a signal to On/Off pin 1 on interface plug 115, which switches off power switch 310, which in turn switches off lamp 135.

System 400 may be standalone system (i.e., "island control"), which operates independently of any external control. Further, system 400 may use a different type of sensor 405 other than a motion sensor or a light harvesting sensor. In any a case, sensor 405 may draw power from the voltage provided on pin 4 of interface plug 115, and provide an On/Off signal on pin 1 of interface plug 115. Further, system 400 may use a dimming ballast 122 in place of the power interface/ballast combination illustrated in FIG. 4. If a dimming ballast 122 is used, sensor 405 may provide a dimmer signal on pin 3 of interface plug 115. It will be readily apparent to one skilled in the art that such variations are possible and within the scope of the invention.

As used herein, the term "lamp ballast device" may refer to dimming ballast 122 of system 100 or the combination of power interface 305 and ballast 315 of system 300. Further, the term "host device" may refer to any of the transceivers or sensors described herein that provides on/off control to a lamp ballast device and receives voltage power signal from a lamp ballast device.

FIG. 500 illustrates an exemplary system 500 that implements wireless control of a lighting system based on the output of a sensor 505. Here, sensor 505 may be, for example, a motion sensor or a light harvesting sensor, although other types of sensors may be used. System 500 may be substantially similar to systems 100 and 300 described above, with sensor 505 taking the place of user interface computer 160.

Sensor 505 may have a power interface 125, which converts AC power into a low DC voltage signal that is provided to a transceiver 105*a* that is connected to sensor 505 by interface cable 120. Transceiver 105*a* may be substantially similar to transceiver 105 that is connected to power interface 305.

System 500 may work as follows. Sensor 505 detects an event that warrants switching on lamp 135. If sensor 505 is a motion detector, the event may be motion in the vicinity of sensor 505. If sensor 505 is a light harvesting sensor, the event may be a change in ambient lighting conditions. Either way, sensor 505 sends a signal to transceiver 105*a* to turn on lamp 135. In doing so, sensor 505 may provide a signal through the On/Off pin 1 of interface plug 115, or through dimmer control pin 3 on plug 115.

Transceiver 105*a* receives the signal from sensor 505. In doing so, the interface circuit (not shown) in transceiver 105*a* may respond to a change in voltage at the appropriate pin on interface plug 115, and provide a signal to the data processing unit (not shown) in transceiver 105*a*. The data processing unit may issue a command that is transmitted over wireless link 150. Transceiver 105 receives the command and in response turns on lamp 135 in a manner similar to that described above with regard to system 300.

System 500 may be deployed in many ways. For example, if sensor 505 is a light harvesting sensor, it could provide lighting control to all the south-facing offices in a building. Similar variations are possible if sensor 505 is a motion sensor, or any other appropriate type of sensor. Further, sensor 505 may be controlled by a computer (not shown) that communicates with sensor 505 over another wireless link 150. It will be readily apparent to one skilled in the art that many variations to system 500 are possible and within the scope of the invention.

Figure 6:
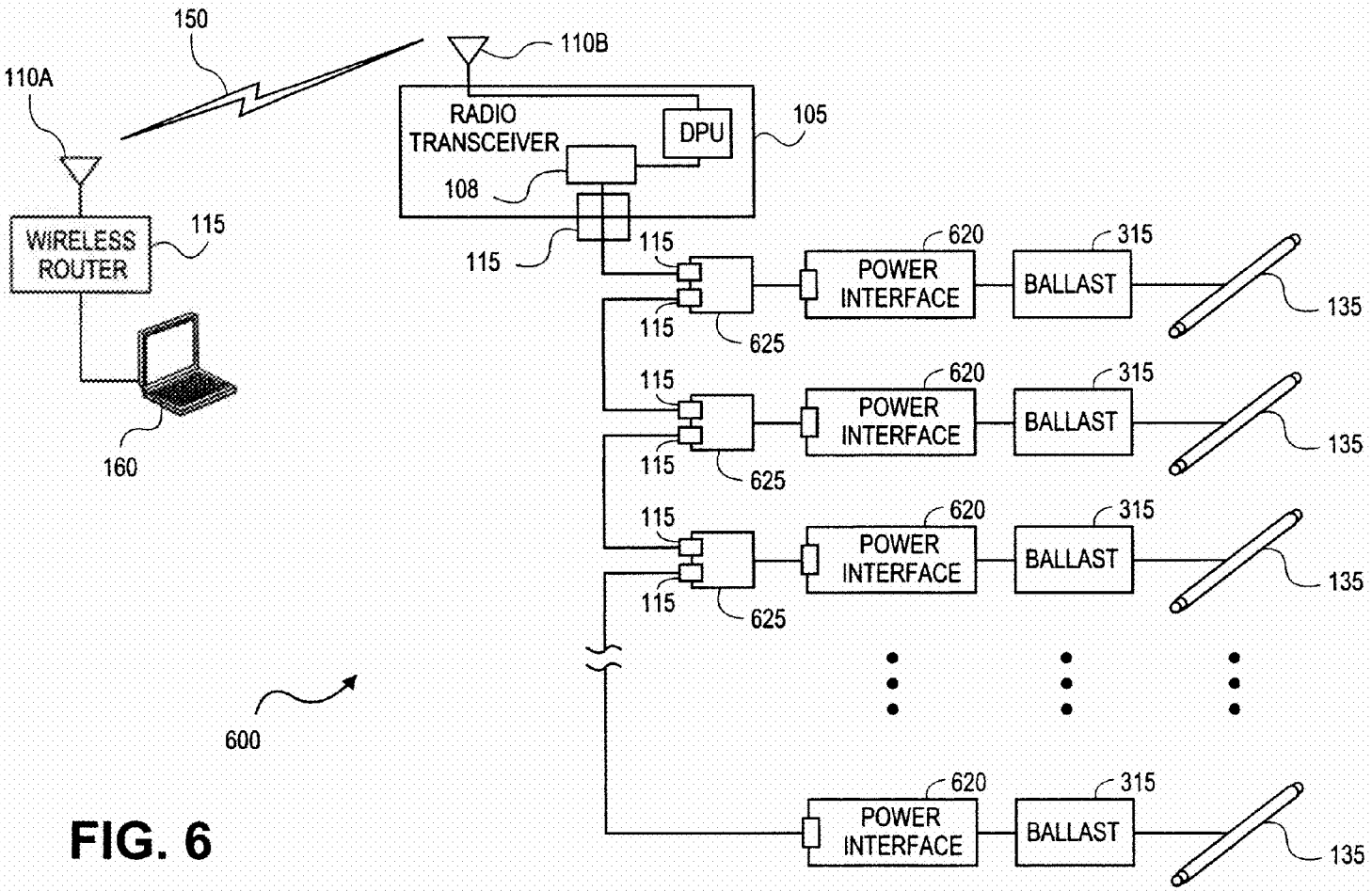
FIG. 6 illustrates an exemplary system employing wireless control of a plurality of relays to control a lighting system using standard ballasts.

FIG. 6 illustrates an exemplary system 600 employing wireless control of a plurality of relays to control a lighting system using standard ballasts. System 600 may be considered similar to system 400, but with multiple lamp ballast device combinations that enable variable lighting control in a room using low-cost ballasts. Variable lighting may be achieved by turning on/off different combinations of lamps in a "checkerboard" fashion.

System 600 includes a transceiver 105 and a plurality of power interfaces 620, each of which is connected to a ballast 315. Power interfaces 620 may be connected to transceiver 105 by an interface cable 120 in a "daisy chain" configuration.

Transceiver 105 is connected to first power interface 620 by a single power interface cable 120 via a Y combiner 625. Power interface cable 120 is connected to a first input of Y combiner 625, and the other input of Y combiner is connected to a second power interface cable 120 that is connected to another Y combiner 625. Each Y combiner 625 has an output that respectively connects to a power interface 620. In this fashion, a plurality of ballasts 315 can be daisy chained.

Each Y combiner 625 may be a standard 2:1 RJ-11 Y combiner. Each Y combiner may have two female input jacks and a male plug. Each Y combiner 625 may be a commercially-available device.

Each power interface 620 is connected to an AC source (not shown) in a manner similar to power interface 305 discussed above. Each power interface 620 has an power converter (not shown) and a power switch (not shown) that are substantially similar to the power converter 125 and power switch 310 in power interface 305. Power interface 620 interface further includes a diode connected in series from the power converter, wherein the diode's cathode is toward interface jack 115. This may prevent back-flow of power from a given ballast 315 to the next ballast 315 of system 600. Accordingly, system 600 enables ballasts 315 to be connected to transceiver 105 in various series and parallel combinations.

Lighting may be modulated in a room in a checkerboard fashion by having two instantiations of system 600 within a room, wherein each instantiation may have a plurality of ballasts 315 daisy-chained together. For example, a first system 600, which as a first plurality of ballasts 315 daisy-chained together, receives a command from user interface computer 160 (via wireless link 150) to switch on or off. A second system 600, which has a second plurality of ballasts 315 daisy-chained together, receives a separate command, independent of the command to first system 600, to switch on and off. In this manner, lighting in a room may be modulated at discrete levels according to the number of ballasts 315 respectively in first system 600 and second system 600. One skilled in the art that many combinations of systems 600, and different pluralities of ballasts 315 for each system 600, are possible and within the scope of the invention.

Figure 7:
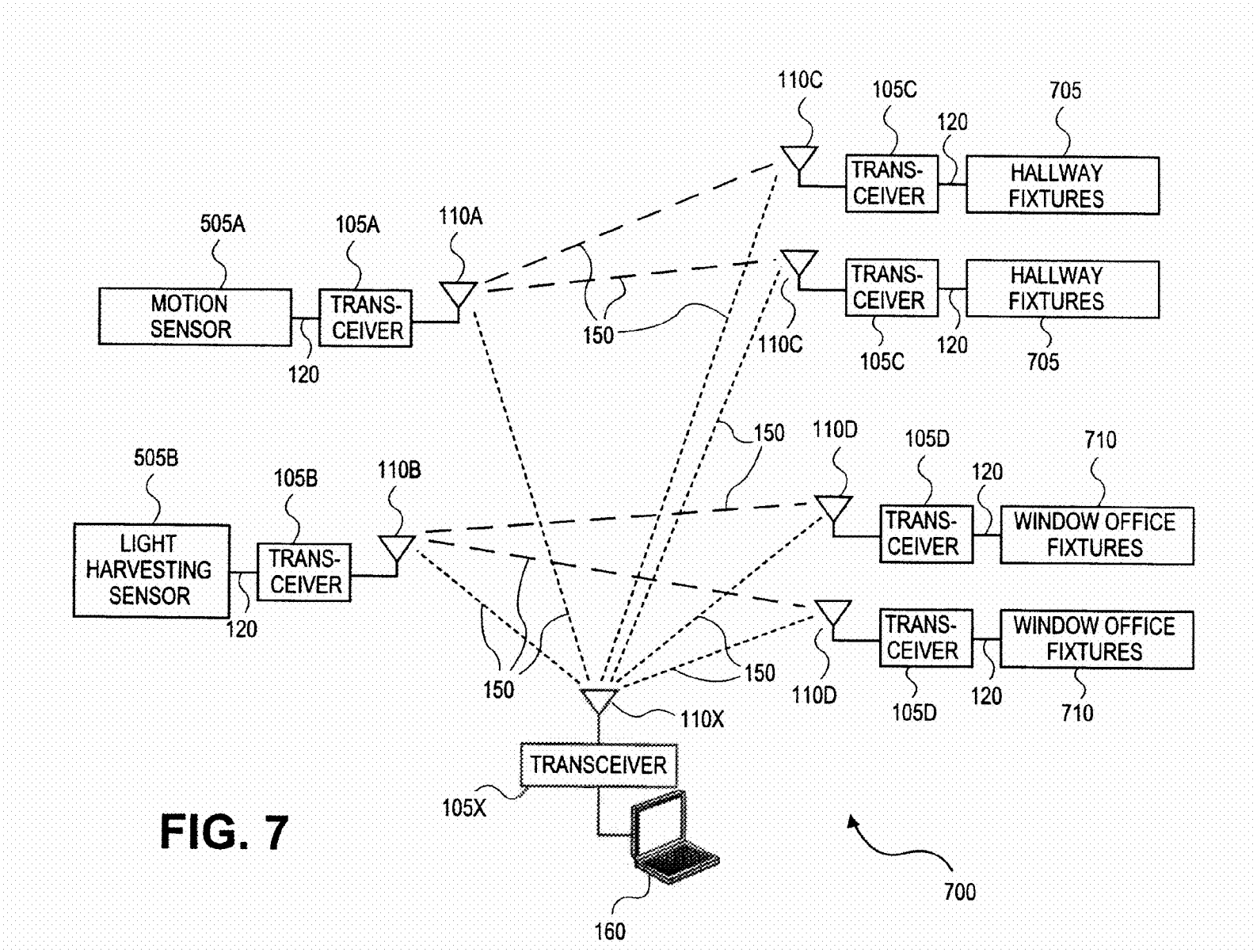
FIG. 7 illustrates an exemplary system employing wireless control to use a combination of light harvesting sensors and motion control sensors to control a plurality of light fixtures according to the present invention.

FIG. 7 illustrates an exemplary system 700 employing wireless control to use a combination of light harvesting sensors and motion control sensors to control a dimming ballast according to the present invention. System 700 includes a user interface computer 160 connected to a transceiver 105*x*; a motion sensor 505*a* connected to a transceiver 505*a* by an interface cable 120; and a light harvesting sensor 505*b* connected a transceiver 105*b* via an interface cable 120. System 700 further includes one or more set of hallway fixtures 705, wherein each set of hallway fixtures 705 is connected to a transceiver 105*c* by an interface cable 120; and one or more set of window office fixtures 710, wherein each set of window office fixtures 710 are connected to a transceiver 105*d* by an interface cable 120.

Transceivers 105*c*, which are connected to sets of hallway fixtures 705, may each be given the same address so that all of the hallway fixtures 705 may be commanded to turn on and off simultaneously. Similarly, transceivers 105*d* may each be given the same address. In doing so, the dip switches (not shown) on each of the transceivers 105*c* and 105*d* may be set accordingly.

System 700 may operate as follows. Motion sensor 505*a* detects motion in its vicinity and sends a signal to transceiver 105*a*, via interface cable 120, to command hallway fixtures 705 to turn on. In doing so, transceiver 105*a* broadcasts a message over wireless link 150 using antenna 110*a*. The message broadcast by transceiver 105*a* includes the address set in transceivers 105*c*. Transceivers 105*c* respond to the message broadcast by transceiver 105*a*, based on the address set in their respective dip switches (not shown). Transceivers 105*c* in turn respectively send a signal to turn on the hallway light fixtures 705. In doing so, transceivers 105*c* apply a signal to the On/Off pin 1 of the interface jack (not shown) of interface cable 120.

Light harvesting sensor 505*b* detects a change in ambient light such that it sends a signal to transceiver 105*b* to turn on or off window office fixtures 710. In doing so, light harvesting sensor 505*b* sends a signal to transceiver 105*b*, which broadcasts an appropriate message over wireless link 150 using antenna 110*b*. The message broadcast by transceiver 105*b* includes the address set in the dip switches (not shown) on transceivers 105*d*. Transceivers 105*d*, based on their addresses, receive the message broadcast by transceiver 105*b* and process the instructions accordingly. In turn, transceivers 105*d* send a signal to their respective window office fixtures 710 via interface cable 120. In doing so, transceivers 105*d* apply a signal to the On/Off pin 1 of the interface jack (not shown) of interface cable 120.

Both of the above functions are substantially similar to that performed by system 500 described above. System 700 may be considered as including two systems 500, one with a motion sensor 505*a*, and another with a light harvesting sensor 505*b*.

Referring again to FIG. 7, user interface computer 160 may be programmed to override the commands provided by transceivers 105*a* and 105*b*, thereby taking direct control of hallway fixtures 705 and window office fixtures 710. In doing so, user interface computer 160 may send an instruction to transceiver 105*x*, which is broadcast over wireless link 150 using antenna 110*x*. The message may include addresses set in the dip switches (not shown) of transceivers 105*c* and 105*d*. One message may be sent to both sets of transceivers, or two messages may be sent, one to transceivers 105*c* and another to transceivers 105*d*. The message sent by transceiver 105*x* may include instructions to turn on or off hallway fixtures 705 and/or window office fixtures 710. The message sent by transceiver 105*x* may also include an instruction to disregard any instructions received from motion sensor 505*a* and/or light harvesting sensor 505*b*.

Further to system 700, user interface computer 160 may be used to configure motion sensor 505*a* and light harvesting sensor 505*b*. For this scenario, transceivers 105*a* and 105*b* may have unique addresses set in their respective dip switches (not shown). User interface computer 160 may send instructions to transceiver 105*x* to broadcast a message to each of transceivers 105*a* and 105*b*. The messages may respectively include the address of the transceiver 105*a* or 105*b*, and a given configuration command for the motion sensor 505*a* or the light harvesting sensor 505*b*.

Although the above exemplary operation description for system 700 involves turning on and off hallway fixtures 705 and window office fixtures 710, it may also include dimmer commands. One skilled in the art will readily recognize that different operation scenarios are possible and within the scope of the invention.

Figure 8:
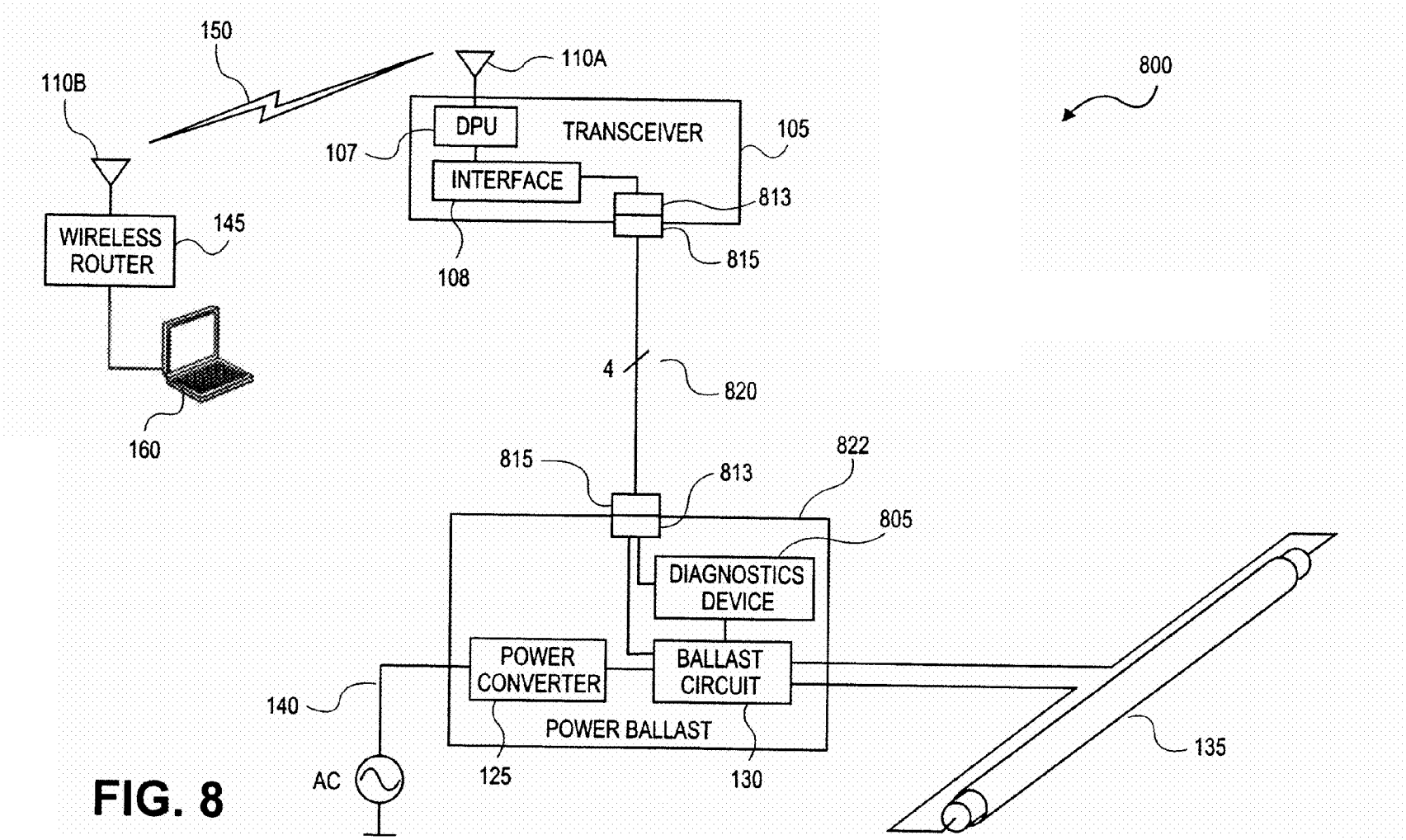
FIG. 8 illustrates a variation to the system illustrated in FIG. 1 that includes a lamp life diagnostic device.

FIG. 8 illustrates a variation of system 800 in which dimming ballast 822 includes a lamp life diagnostic device 805. Diagnostics device 805 detects lamp life by monitoring the power drawn by ballast circuit 130. Diagnostics device 805 provides lamp life information to transceiver 105 interface cable 820 having interface plugs 815. In order to accommodate this additional information, system 800 has includes a ballast interface cable 820 with at least one additional conductor. Also, the interface plugs 815 on ballast interface cable 820, and the corresponding jacks 813, each have at least one additional pin corresponding to the additional conductor(s). Here, interface plug 815 may be an RJ14 telephone jack, although other similar jacks or plugs may be used, provided that it has a sufficient number of conductors and can be easily connected or disconnected in hard to reach places.

Variations to the embodiments described above are possible and within the scope of the invention. For example, interface plug 115 may have additional conductors, as discussed above, in which an eight pin RJ45 plug may be used for interface cable 120. In this case, additional signals may be incorporated into the standard interface according to the present invention. Additional signals may include, for example, a lamp outage detection signal. One skilled in the art will readily appreciate that such variations are possible and within the scope of the invention.

Figure 5:
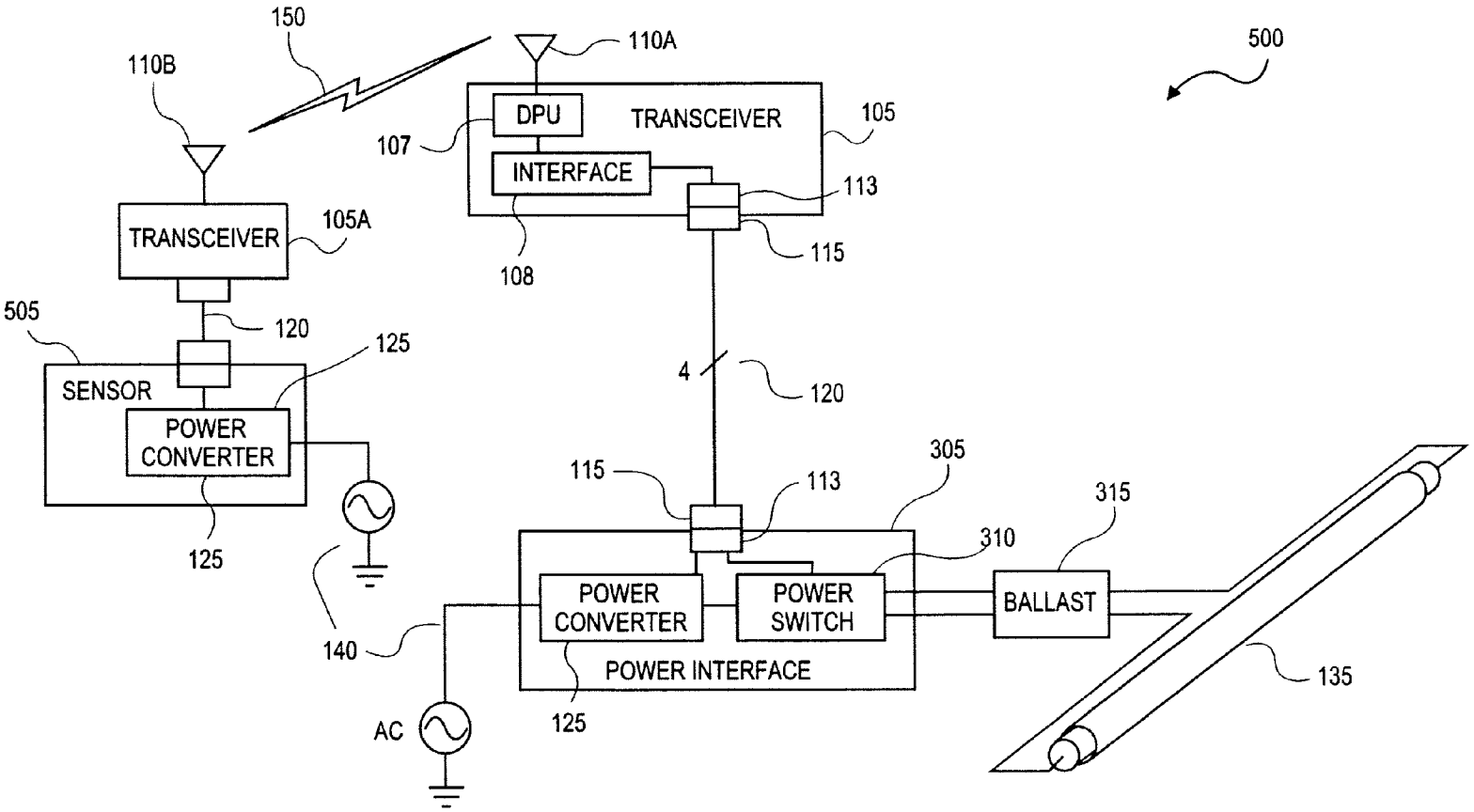
FIG. 5 illustrates an exemplary system using a sensor to control a standard ballast over a wireless connection.

In a variation to system 500, sensor 505 may derive power from power interface 305, instead of having its own AC power source 140. This variation may make use of the Y combiner 625 discussed with regard to exemplary system 600 above. Referring to FIG. 5, a Y combiner (not shown) may be introduced between transceiver 105 and power interface 305 such that the output of the Y combiner is connected to jack 113 of power interface 305. Interface cable 120 may connect transceiver 105 to one input of the Y combiner, and a second interface cable (not shown) may be connected to the Y combiners' other input. The other end of the second interface cable is connected to a second jack (not shown) in sensor 505, which is designated for input power only. In this configuration, power converter 125 of power interface 305 may provide power to sensor 505 and transceivers 105 and 105*a*. In this variation to system 505, only one connection to AC source 140 may be necessary.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A transceiver for a wireless lighting control system, comprising:

a data processing unit;

an interface circuit connected to the data processing unit; and a jack that is connectable to an interface plug, the jack having a first pin corresponding to an on/off signal, a second pin corresponding to a ground signal, and a third pin corresponding to a voltage power signal that provides power to the transceiver, wherein the data processing unit has a computer readable medium encoded with a program for receiving a command signal from an external controller and for sending a control signal to the interface circuit, wherein the control signal corresponds to the command signal, and wherein the on/off signal is a function of the control signal.

2. The transceiver of claim 1, further comprising an antenna.

3. The transceiver of claim 1, further comprising a binary switch connected to the data processing unit.

4. The transceiver of claim 1, wherein the control signal corresponds to an on signal that gets applied to the first pin of the jack.

5. The transceiver of claim 1, wherein the jack further includes a fourth pin corresponding to a dimmer signal.

6. The transceiver of claim 1, wherein the control signal corresponds to a dimmer voltage that gets applied to the fourth pin of the jack.

7. An interface device for a lighting system, comprising:

a cable having a plurality of conductors; and an interface plug disposed at an end of the cable, wherein the interface plug has a first pin that conducts an on/off signal from a host device to a lamp ballast device, a second pin that conducts a ground signal from the lamp ballast device to the host device, and a third pin that conducts a low voltage signal from the lamp ballast device to the host device for providing power to the host device, wherein the first pin, the second pin, and the third pin correspond to the plurality of conductors.

8. The interface device of claim 7, wherein the interface plug further includes a fourth pin that conducts a dimmer voltage signal from the host device to the lamp ballast device.

9. The interface device of claim 8, wherein the interface plug comprises an RJ11 plug.

10. A power interface device for a lighting control system, comprising:

a power converter;

a power switch; and a jack connected to the power converter and the power switch, wherein the jack has a first pin that corresponds to an On/Off signal, wherein the first pin is connected to the power switch; a second pin that corresponds to a ground signal, wherein the second pin is connected to the power converter; and a third pin that corresponds to a DC voltage, wherein the third pin is connected to the power converter.

11. The power interface device of claim 10, wherein the jack further comprises a fourth pin that corresponds to a dimmer signal.

* * * * *